US007643989B2

(12) United States Patent
Deng et al.

(10) Patent No.: US 7,643,989 B2
(45) Date of Patent: Jan. 5, 2010

(54) METHOD AND APPARATUS FOR VOCAL TRACT RESONANCE TRACKING USING NONLINEAR PREDICTOR AND TARGET-GUIDED TEMPORAL RESTRAINT

(75) Inventors: Li Deng, Sammamish, WA (US); Alejandro Acero, Bellevue, WA (US); Issam Bazzi, New York, NY (US)

(73) Assignee: Microsoft Corporation, Redmond, WA (US)

( * ) Notice: Subject to any disclaimer, the term of this patent is extended or adjusted under 35 U.S.C. 154(b) by 1225 days.

(21) Appl. No.: 10/652,976

(22) Filed: Aug. 29, 2003

(65) Prior Publication Data

US 2005/0049866 A1 Mar. 3, 2005

(51) Int. Cl.
*G10L 19/06* (2006.01)

(52) U.S. Cl. ..... 704/209; 704/240

(58) Field of Classification Search ..... 704/256, 704/240, 209, 220, 221, 243, 245
See application file for complete search history.

(56) References Cited

U.S. PATENT DOCUMENTS

| | | | | |
|---|---|---|---|---|
| 6,064,958 | A * | 5/2000 | Takahashi et al. | 704/243 |
| 6,141,644 | A * | 10/2000 | Kuhn et al. | 704/273 |
| 6,236,963 | B1 * | 5/2001 | Naito et al. | 704/241 |
| 6,493,667 | B1 * | 12/2002 | de Souza et al. | 704/240 |
| 6,499,012 | B1 * | 12/2002 | Peters et al. | 704/256.4 |
| 6,502,066 | B2 * | 12/2002 | Plumpe | 704/209 |
| 6,980,952 | B1 * | 12/2005 | Gong | 704/234 |
| 7,181,395 | B1 * | 2/2007 | Deligne et al. | 704/249 |
| 2004/0199386 | A1 * | 10/2004 | Attias et al. | 704/240 |

OTHER PUBLICATIONS

Mark Hasegawa-Johnson. Multivariate state hidden Markov models for simultaneous transcription of phones and formants. In Proc. ICASSP, vol. 3, pp. 1323-1327, Istanbul, 2000.*

L. Deng and J. Ma, "A statistical coarticulatory model for the hidden vocal-tract-resonance dynamics," in Proc. Eurospeech Budapest, Hungary, 1999, pp. 1499-1502.*

(Continued)

*Primary Examiner*—Talivaldis Ivars Smits
*Assistant Examiner*—Greg A Borsetti
(74) *Attorney, Agent, or Firm*—Theodore M. Magee; Westman, Champlin & Kelly, P.A.

(57) ABSTRACT

A method and apparatus map a set of vocal tract resonant frequencies, together with their corresponding bandwidths, into a simulated acoustic feature vector in the form of LPC cepstrum by calculating a separate function for each individual vocal tract resonant frequency/bandwidth and summing the result to form an element of the simulated feature vector. The simulated feature vector is applied to a model along with an input feature vector to determine a probability that the set of vocal tract resonant frequencies is present in a speech signal. Under one embodiment, the model includes a target-guided transition model that provides a probability of a vocal tract resonant frequency based on a past vocal tract resonant frequency and a target for the vocal tract resonant frequency. Under another embodiment, the phone segmentation is provided by an HMM system and is used to precisely determine which target value to use at each frame.

15 Claims, 5 Drawing Sheets

OTHER PUBLICATIONS

Dusan, 2000. Dusan, S., 2000. Statistical estimation of articulatory trajectories from the speech signal using dynamical and phonological constraints. Ph.D. Thesis, Department of Electrical and Computer Engineering, University of Waterloo, Waterloo, Canada, April.*

Slifka, J., Anderson, T.R., 1995. Speaker modification with LPC pole analysis. In: ICASSP-95, vol. 1, pp. 644-647.*

G. Zhou, J. Hansen, and J. F. Kaiser, "Linear and nonlinear speech feature analysis for stress classification," in Int. Conf. Speech Language Processing Sydney, Australia, Dec. 1998, pp. 840-843.*

L. Deng and J. Ma, "Spontaneous speech recognition using a statistical coarticulatory model for the hidden vocal-tract-resonance dynamics," J. Acoust. Soc. Amer., vol. 108, No. 6, pp. 3036-3048, Dec. 2000.*

P. Zolfaghari and T. Robinson, "Formant analysis using mixtures of Gaussians," in Proc. Eurospeech Rhodes, Greece, 1997, pp. 2539-2542.*

A. Acero, "Formant analysis and synthesis using hidden Markov models," in Proc. of the Eurospeech Conference, Budapest, 1999.

I. Bazzi, A. Acero, and L. Deng, "An expectation-maximization approach for formant tracking using a parameter-free non-linear predictor," Proc. ICASSP, Hong Kong, Apr. 2003.

L. Deng, J. Droppo, and A. Acero, "A Bayesian approach to speech feature enhancement using the dynamic cepstral prior," Proc. ICASSP, Orlando, Florida, 2002.

L. Deng and J. Ma, "Spontaneous speech recognition using a statistical coarticulatory model for the hidden vocal-tract-resonance dynamics," J. Acoust. Soc. Am., vol. 108, 2000.

F. Seide, J.L. Zhou, and L. Deng, "Coarticulation modeling by embedding a target-directed hidden trajectory model into HMM-MAP decoding and evaluation," Proc. ICASSP, Hong Kong, Apr. 2003.

Xuedong Huang et al., "Spoken Language Processing: A Guide to Theory, Algorithm and System Development," 2001, Prentice Hall, pp. 306-315.

European Search Report from European Patent Application No. 04103539.5, filed Jul. 23, 2004.

Official Communication from European Patent Application No. 04103539.5, filed Jul. 23, 2004.

Official Communication from European Patent Application No. 06008561.0, filed Jul. 23, 2004.

Li Deng et al., "Tracking Vocal Tract Resonances Using An Analytical Nonlinear predictor and a Target-Guided temporal Constraint," Eurospeech 2003, pp. 73-76.

First Office Action issued Dec. 5, 2008 in Chinese Patent Application No. 200410068599.9, filed Aug. 27, 2004.

* cited by examiner

METHOD AND APPARATUS FOR VOCAL TRACT RESONANCE TRACKING USING NONLINEAR PREDICTOR AND TARGET-GUIDED TEMPORAL RESTRAINT

BACKGROUND OF THE INVENTION

The present invention relates to speech recognition systems and in particular to speech recognition systems that exploit vocal tract resonances in speech.

In human speech, a great deal of information is contained in the first three or four resonant frequencies of the speech signal. In particular, when a speaker is pronouncing a vowel, the frequencies (and to a less extent, bandwidths) of these resonances indicate which vowel is being spoken.

Such resonant frequencies and bandwidths are often referred to collectively as formants. During sonorant speech, which is typically voiced, formants can be found as spectral prominences in a frequency representation of the speech signal. However, during non-sonorant speech, the formants cannot be found directly as spectral prominences. Because of this, the term "formants" has sometimes been interpreted as only applying to sonorant portions of speech. To avoid confusion, some researchers use the phrase "vocal tract resonance" to refer to formants that occur during both sonorant and non-sonorant speech. In both cases, the resonance is related to only the oral tract portion of the vocal tract.

To detect formants, systems of the prior art analyzed the spectral content of a frame of the speech signal. Since a formant can be at any frequency, the prior art has attempted to limit the search space before identifying a most likely formant value. Under some systems of the prior art, the search space of possible formants is reduced by identifying peaks in the spectral content of the frame. Typically, this is done by using linear predictive coding (LPC) which attempts to find a polynomial that represents the spectral content of a frame of the speech signal. Each of the roots of this polynomial represents a possible resonant frequency in the signal and thus a possible formant. Thus, using LPC, the search space is reduced to those frequencies that form roots of the LPC polynomial.

In other formant tracking systems of the prior art, the search space is reduced by comparing the spectral content of the frame to a set of spectral templates in which formants have been identified by an expert. The closest "n" templates are then selected and used to calculate the formants for the frame. Thus, these systems reduce the search space to those formants associated with the closest templates.

One system of the prior art, developed by the same inventors as the present invention, used a consistent search space that was the same for each frame of an input signal. Each set of formants in the search space was mapped into a feature vector. Each of the feature vectors was then applied to a model to determine which set of formants was most likely.

This system works well but is computationally expensive because it typically utilizes Mel-Frequency Cepstral Coefficient frequency vectors, which require the application of a set of frequencies to a complex filter that is based on all of the formants in the set of formants that is being mapped followed by a windowing step and a discrete cosine transform step in order to map the formants into the feature vectors. This computation was too time-consuming to be performed at run time and thus all of the sets of formants had to be mapped before run time and the mapped feature vectors had to be stored in a large table. This is less than ideal because it requires a substantial amount of memory to store all of the mapped feature vectors.

In addition, the mapping provided by the MFCC system is difficult to invert because the formants are combined as a product before performing the windowing function.

Thus, a formant tracking system is needed that does not reduce the search space in such a way that the formants in different frames of the speech signal are identified using different formant search spaces while at the same time limiting the amount of memory and computational resources that are needed to identify the formants.

In addition, formant trackers of the past have not utilized formant targets when determining a likelihood of a change in formants over time. Instead, past systems have used generic continuity constraints. However, such systems have not performed well in non-sonorant speech regions.

SUMMARY OF THE INVENTION

A method and apparatus map a set of vocal tract resonant frequencies into a simulated feature vector by calculating a separate function for each individual vocal tract resonant frequency and summing the result to form an element of the simulated feature vector. The simulated feature vector is applied to a model along with an input feature vector to determine a probability that the set of vocal tract resonant frequencies is present in a speech signal. Under one embodiment, the model includes a target-guided transition model that provides a probability of a vocal tract resonant frequency based on a past vocal tract resonant frequency and a target for the vocal tract resonant frequency.

DETAILED DESCRIPTION OF ILLUSTRATIVE EMBODIMENTS

Figure 1:
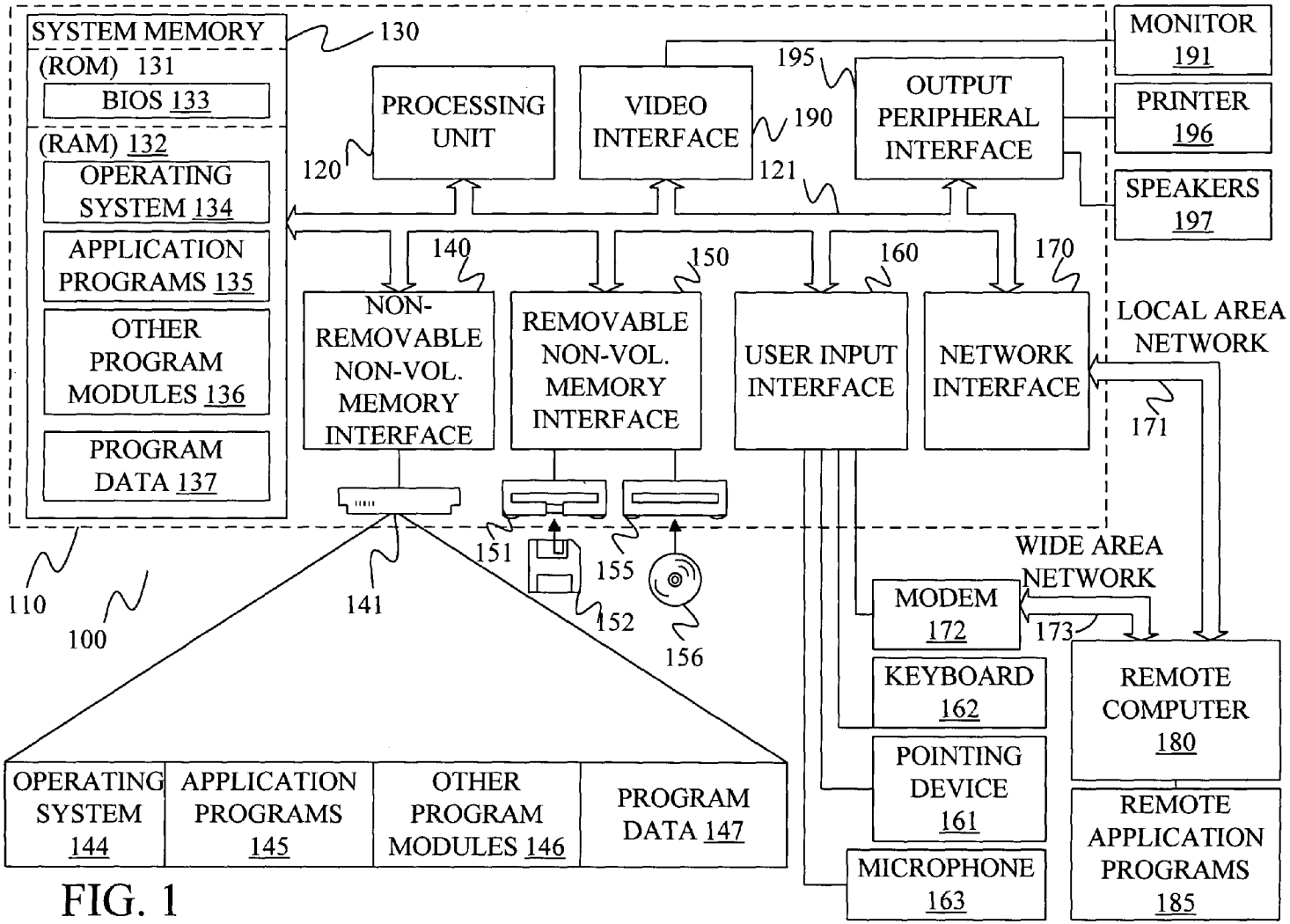
FIG. 1 is a block diagram of a general computing environment in which embodiments of the present invention may be practiced.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, telephony systems, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention is designed to be practiced in distributed computing environments where tasks are performed by remote processing devices that are linked through a communications network. In a distributed computing environment, program modules are located in both local and remote computer storage media including memory storage devices.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 195.

The computer 110 is operated in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
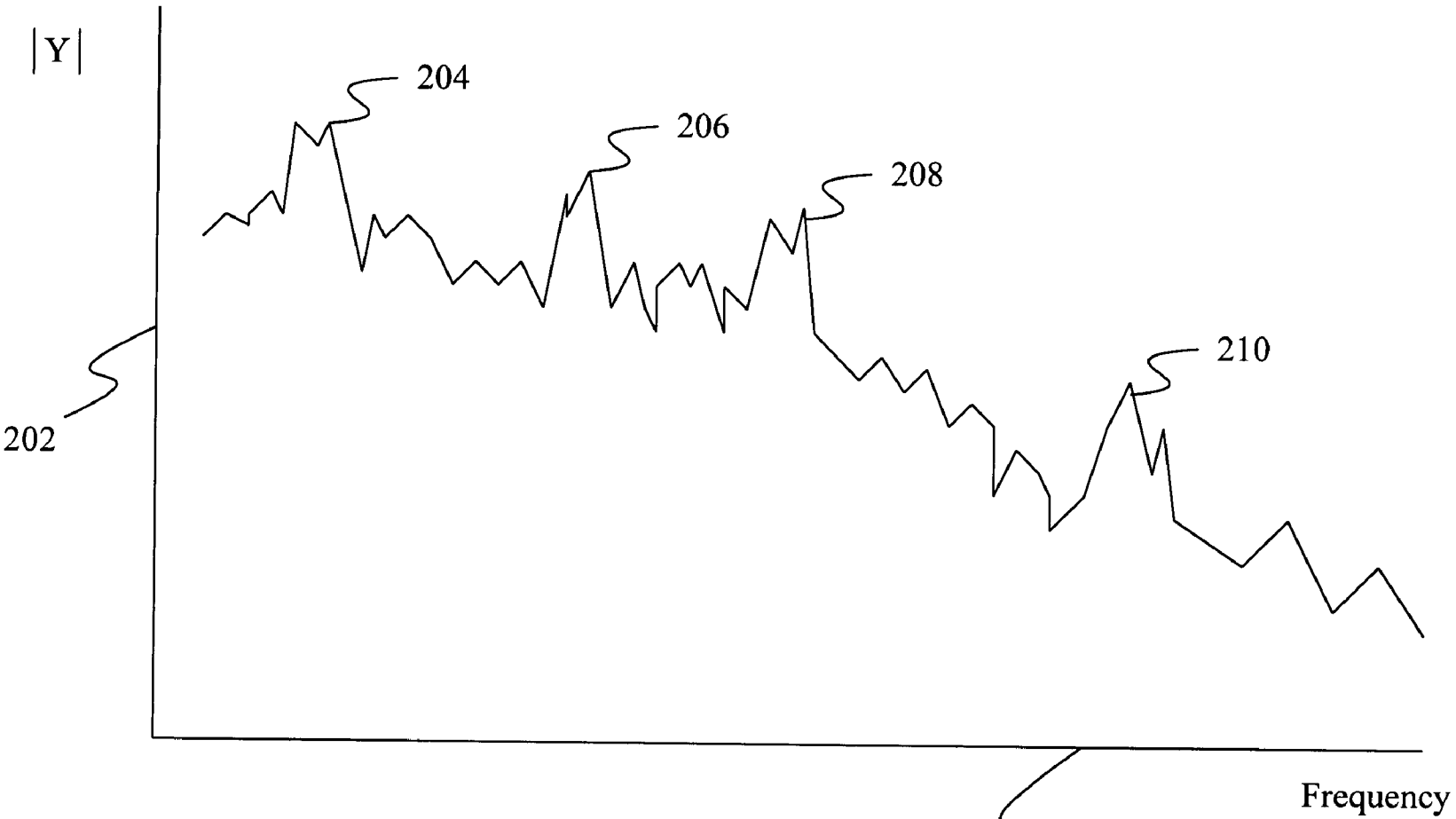
FIG. 2 is a graph of the magnitude spectrum of a speech signal.

FIG. 2 is a graph of the frequency spectrum of a section of human speech. In FIG. 2, frequency is shown along horizontal axis 200 and the magnitude of the frequency components is shown along vertical axis 202. The graph of FIG. 2 shows that sonorant human speech contains resonances or formants, such as first formant 204, second formant 206, third formant 208, and fourth formant 210. Each formant is described by its center frequency, F, and its bandwidth, B.

Figure 3:
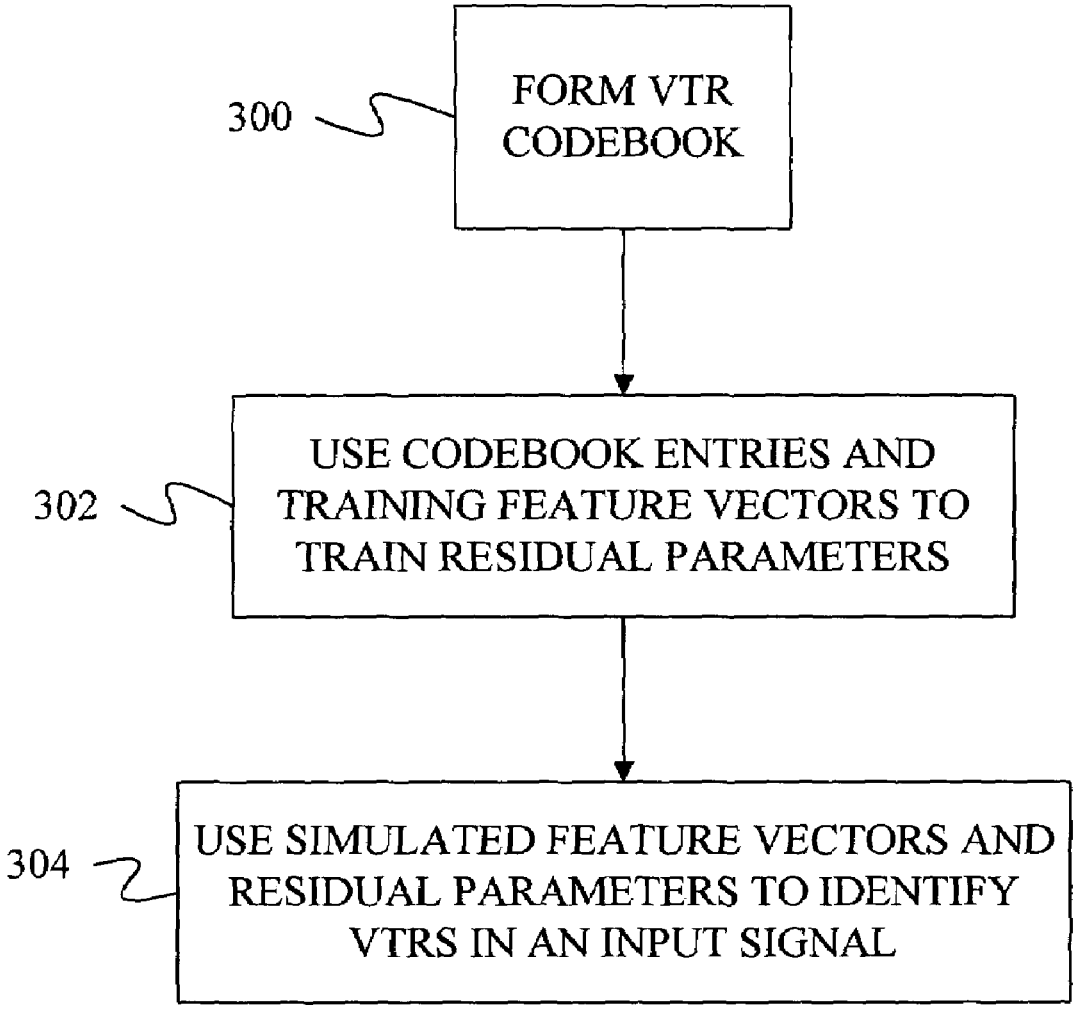
FIG. 3 is a flow diagram of a method under the present invention.

The present invention provides methods for identifying the formant frequencies and bandwidths in a speech signal, both in sonorant and non-sonorant speech. Thus, the invention is able to track vocal tract resonances. FIG. 3 provides a general flow diagram for these methods.

In step 300 of FIG. 3, a vocal tract resonance (VTR) codebook, stored in a table, is constructed by quantizing the possible VTR frequencies and bandwidths to form a set of quantized values and then forming entries for different combinations of the quantized values. Thus, the resulting codebook contains entries that are vectors of VTR frequencies and bandwidths. For example, if the codebook contains entries for four VTRs, the ith entry x[i] in the codebook would be a vector of $[F_{1i}, B_{1i}, F_{2i}, B_{2i}, F_{3i}, B_{3i}, F_{4i}, B_{4i}]$ where $F_{1i}$, $F_{2i}$, $F_{3i}$, and $F_{4i}$ are the frequencies of the first, second, third and fourth VTRs and $B_{1i}$, $B_{2i}$, $B_{3i}$, and $B_{4i}$ are the bandwidths for the first, second, third and fourth VTRs. In the discussion below, the index to the codebook, i, is used interchangeably with the value stored at that index, x[i]. When the index is used alone below, it is intended to represent the value stored at that index.

Under one embodiment, the formants and bandwidths are quantized according to the entries in Table 1 below, where Min(Hz) is the minimum value for the frequency or bandwidth in Hertz, Max(Hz) is the maximum value in Hertz, and "Num. Quant." is the number of quantization states. For the frequencies and the bandwidths, the range between the minimum and maximum is divided by the number of quantization states to provide the separation between each of the quantization states. For example, for bandwidth $B_1$ in Table 1, the range of 260 Hz is evenly divided by the 5 quantization states such that each state is separated from the other states by 65 Hz. (i.e., 40, 105, 170, 235, 300).

TABLE 1

| | Min (Hz) | Max (Hz) | Num. Quant. |
|---|---|---|---|
| F1 | 200 | 900 | 20 |
| F2 | 600 | 2800 | 20 |
| F3 | 1400 | 3800 | 20 |
| F4 | 1700 | 5000 | 40 |
| B1 | 40 | 300 | 5 |
| B2 | 60 | 300 | 5 |
| B3 | 60 | 500 | 5 |
| B4 | 100 | 700 | 10 |

The number of quantization states in Table 1 could yield a total of more than 100 million different sets of VTRs. However, because of the constraint $F_1<F_2<F_3<F_4$ there are substantially fewer sets of VTRs in the VTR search space defined by the codebook.

After the codebook has been formed, the entries in the codebook are used to train parameters that describe a residual random variable at step 302. The residual random variable is the difference between a set of observation training feature vectors and a set of simulated feature vectors. In terms of an equation:

$$v_t = o_t - C(x_t[i]) \qquad \text{EQ. 1}$$

where $v_t$ is the residual, $o_t$ is the observed training feature vector at time t and $C(x_t[i])$ is a simulated feature vector.

Figure 4:
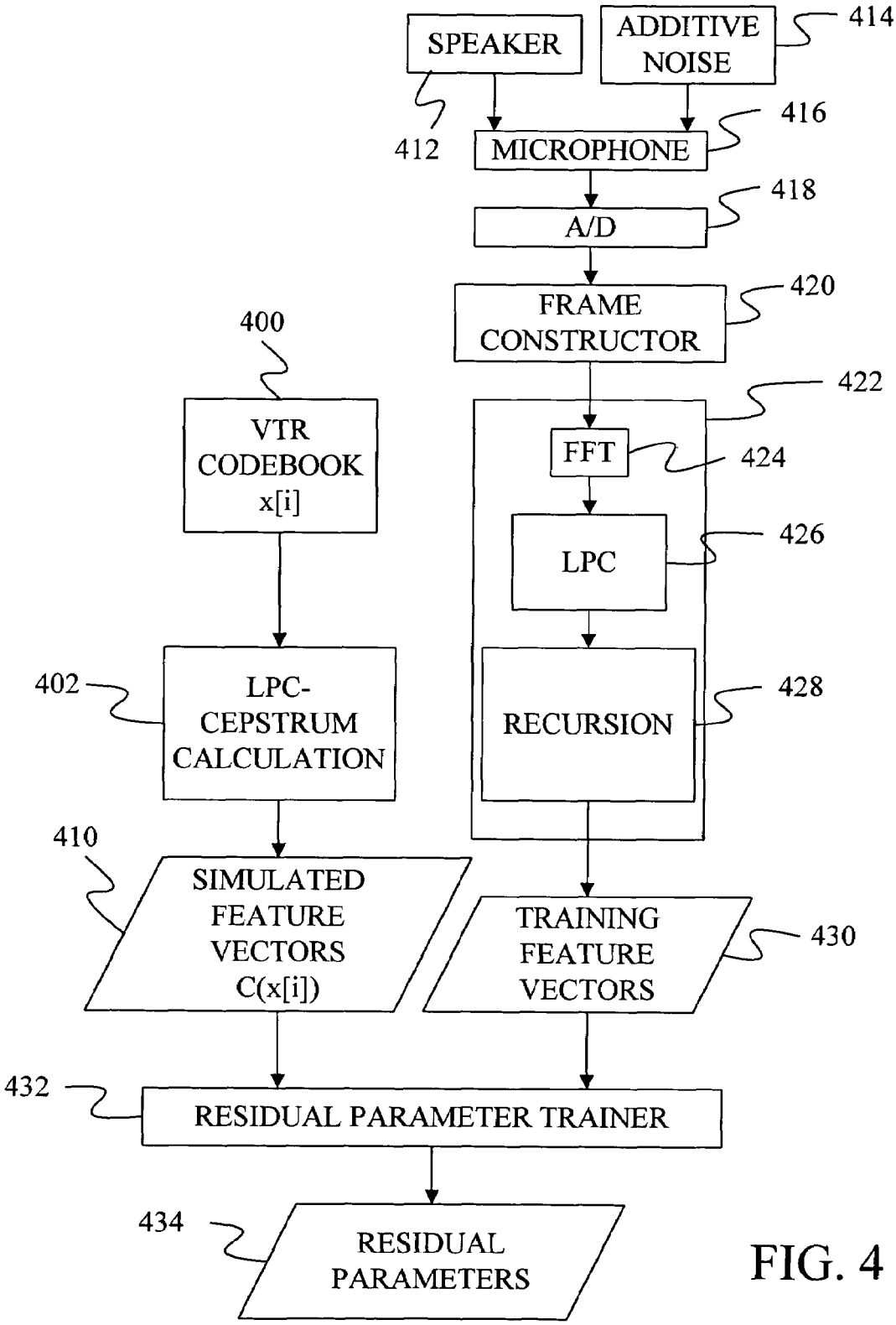
FIG. 4 is a block diagram of a training system for training a residual model under one embodiment of the present invention.

As shown in FIG. 4, the simulated feature vectors $C(x_t[i])$ 410 are constructed when needed by applying a set of VTRs $x_t[i]$ in VTR codebook 400 to an LPC-Cepstrum calculator 402, which performs the following calculation:

$$C_n(x_t[i]) = \sum_{k=1}^{K} \frac{2}{n} e^{-m\frac{b_k[i]}{f_s}} \cos\left(2\pi n \frac{f_k[i]}{f_s}\right) \qquad \text{EQ. 2}$$

where $C_n(x_t[i])$ is the nth element in an nth order LPC-Cepstrum feature vector, K is the number of VTRs, $f_k$ is the kth VTR frequency, $b_k$ is the kth VTR bandwidth, and $f_s$ is the sampling frequency, which in many embodiments is 8 kHz. The $C_0$ element is set equal to log G, where G is a gain.

To produce the observed training feature vectors $o_t$ used to train the residual model, a human speaker 412 generates an acoustic signal that is detected by a microphone 416, which also detects additive noise 414. Microphone 416 converts the acoustic signals into an analog electrical signal that is provided to an analog-to-digital (A/D) converter 418. The analog signal is sampled by A/D converter 418 at the sampling frequency $f_s$ and the resulting samples are converted into digital values. In one embodiment, A/D converter 418 samples the analog signal at 8 kHz with 16 bits per sample, thereby creating 16 kilobytes of speech data per second. The digital samples are provided to a frame constructor 420, which groups the samples into frames. Under one embodiment, frame constructor 420 creates a new frame every 10 milliseconds that includes 25 milliseconds worth of data.

The frames of data are provided to an LPC-Cepstrum feature extractor 422, which converts the signal to the frequency domain using a Fast Fourier Transform (FFT) 424 and then identifies a polynomial that represents the spectral content of a frame of the speech signal using an LPC coefficient system 426. The LPC coefficients are converted into LPC cepstrum coefficients using a recursion 428. The output of the recursion is a set of training feature vectors 430 representing the training speech signal.

The simulated feature vectors 410 and the training feature vectors 430 are provided to residual trainer 432 which trains the parameters for the residual $v_t$.

Under one embodiment, $v_t$ is a single Gaussian with mean h and a precision D, where h is a vector with a separate mean for each component of the feature vector and D is a diagonal precision matrix with a separate value for each component of the feature vector.

These parameters are trained using an Expectation-Maximization (EM) algorithm under one embodiment of the present invention. During the E-step of this algorithm, a posterior probability $\gamma_t(i)=p(x_t[i]|o_1^N)$ is determined. Under one embodiment, this posterior is determined using a backward-forward recursion defined as:

$$\gamma_t(i) = \frac{\alpha_t(i)\beta_t(i)}{\sum_i \alpha_t(i)\beta_t(i)} \quad \text{EQ. 3}$$

where $\alpha_t(i)$ and $\beta_t(i)$ are recursively determined as:

$$\alpha_t(i) = \sum_j \alpha_{t-1}(j)p(x_t[i]|x_{t-1}[j])p(o_t|x_t[i] = x[i]) \quad \text{EQ. 4}$$

$$\beta_t(i) = \sum_j \beta_{t+1}(j)p(x_t[i]|x_{t+1}[j])p(o_t|x_t[i] = x[i]) \quad \text{EQ. 5}$$

Under one aspect of the invention, the transition probabilities $p(x_t[i]|x_{t-1}[j])$ and $p(x_t[i]|x_{t+1}[j])$ are determined using a target-based state equation in the dynamic model parameterized as:

$$x_t(i)=rx_{t-1}(j)+(1-r)T_s+w_t \quad \text{EQ. 6}$$

where $x_t[i]$ is the value of the VTRs at frame t, $x_{t-1}[j]$ is the value of the VTRs at previous frame t−1, r is a rate, $T_s$ is a target for the VTRs that in one embodiment is tied to the speech unit associated with frame t and $w_t$ is the noise at frame t, which in one embodiment is assumed to be a zero-mean Gaussian with a precision matrix B.

Using this dynamic model, the transition probabilities can be described as Gaussian functions:

$$p(x_t[i]|x_{t-1}[j])=N(x_t[i];rx_{t-1}(j)+(1-r)T_s,B) \quad \text{EQ. 7}$$

$$p(x_t[i]|x_{t+1}[j])=N(x_{t+1}[i];rx_t(j)+(1-r)T_s,B) \quad \text{EQ. 8}$$

Where $T_s$ is selected based on an assignment of frames to speech units that is performed using Hidden Markov Model (HMM) segmentation system. Such HMM systems are well known in the art.

Alternatively, the posterior probability $\gamma_t(i)=p(x_t[i]|o_1^N)$ may be estimated by making the probability only dependent on the current observation vector and not the sequence of vectors such that the posterior probability becomes:

$$\gamma_t(i)\approx p(x_t[i]|o_t) \quad \text{EQ. 9}$$

which can be calculated as:

$$p(x_t[i] \mid o_t) = \frac{N(o_t; C(x_t[i]) + \hat{h}, \hat{D})}{\sum_{i=1}^{I} N(o_t; C(x_t[i]) + \hat{h}, \hat{D})} \quad \text{EQ. 10}$$

where $\hat{h}$ is the mean of the residual and $\hat{D}$ is the precision of the residual as determined from a previous iteration of the EM algorithm or as initially set if this is the first iteration.

After the E-step is performed to identify the posterior probability $\gamma_t(i)=p(x_t[i]|o_1^N)$, an M-step is performed to determine the mean h and each diagonal element $d^{-1}$ of the variance $D^{-1}$ (the inverse of the precision matrix) of the residual using:

$$\hat{h} = \frac{\sum_{t=1}^{N}\sum_{i=1}^{I}\gamma_t(i)\{o_t - C(x_t[i])\}}{N} \quad \text{EQ. 11}$$

$$\hat{d}^{-1} = \frac{\sum_{t=1}^{N}\sum_{i=1}^{I}\gamma_t(i)\{o_t - C(x_t[i]) - \hat{h}\}^2}{N} \quad \text{EQ. 12}$$

where N is the number of frames in the training utterance, I is the number of quantization combinations for the VTRs, $o_t$ is the observed feature vector at time t and $C(x_t[i])$ is a simulated feature vector for VTRs $x_t[i]$.

Residual trainer 432 updates the mean and covariance multiple times by iterating the E-step and the M-step, each time using the mean and variance from the previous iteration. After the mean and variance reach stable values, they are stored as residual parameters 434.

Once residual parameters 434 have been constructed they can be used in step 304 of FIG. 3 to identify VTRs in an input speech signal. A block diagram of a system for identifying formants is shown in FIG. 5.

Figure 5:
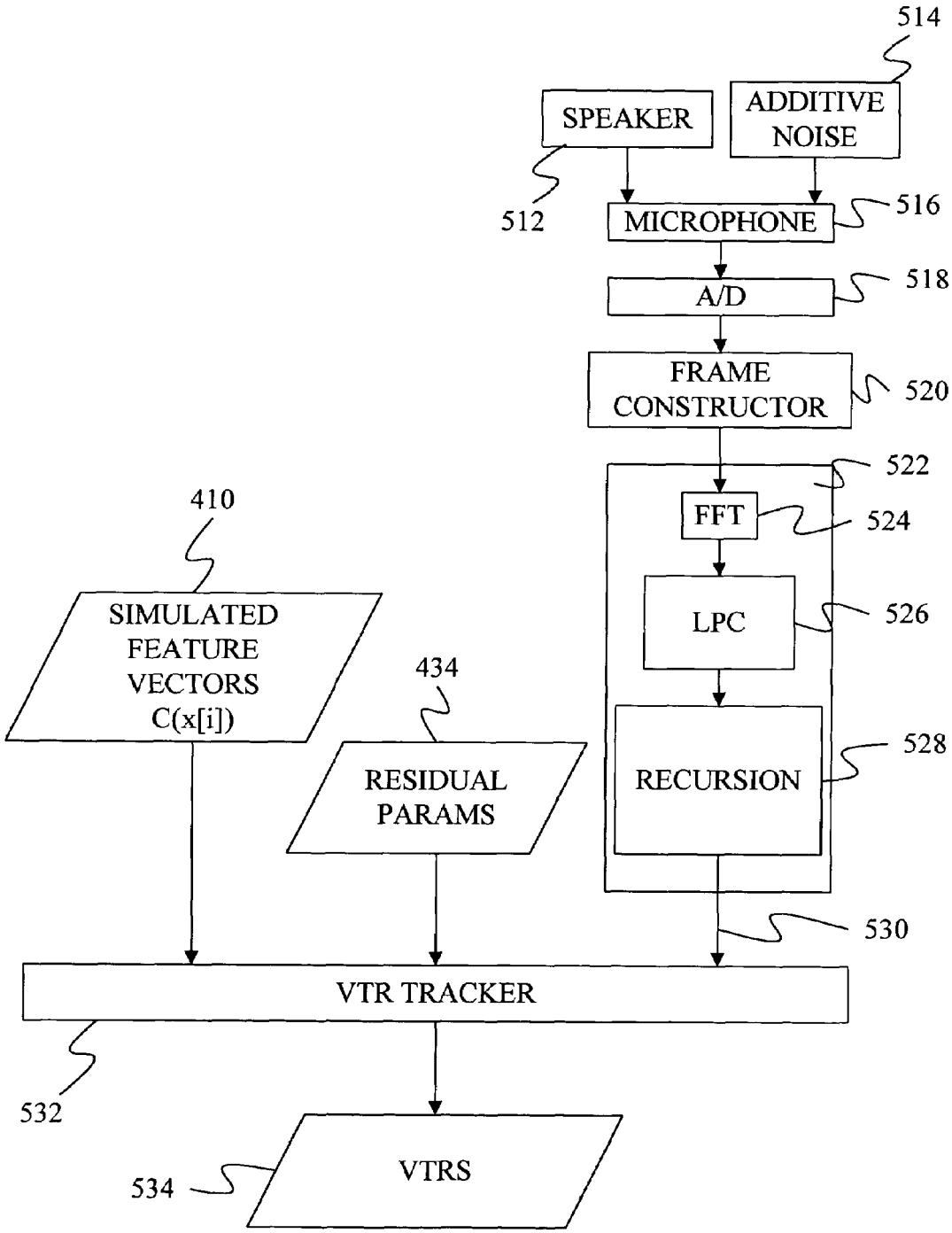
FIG. 5 is a block diagram of a formant tracking system under one embodiment of the present invention.

In FIG. 5, a speech signal is generated by a speaker 512. The speech signal and additive noise 514 are converted into a stream of feature vectors 530 by a microphone 516, A/D converter 518, frame constructor 520, and feature extractor 522, which consists of an FFT 524, LPC system 526, and a recursion 528. Note that microphone 516, A/D converter 518, frame constructor 520 and feature extractor 522 operate in a similar manner to microphone 416, A/D converter 418, frame constructor 420 and feature extractor 422 of FIG. 4.

The stream of feature vectors 530 is provided to a formant tracker 532 together with residual parameters 434 and simulated feature vectors 410. Formant tracker 532 uses dynamic programming to identify a sequence of most likely formants 534. In particular, it utilizes a Viterbi decoding algorithm where each node in the trellis diagram has an optimal partial score of:

$$\delta_t(i) = \max_{x[i]_1^{t-1}} \prod_{\tau=1}^{t-1} p(o_\tau|x_\tau[i])p(o_t|x_t[i] = x[i]) \times p(x[i]_1)\prod_{\tau=2}^{t-1} p(x_\tau[i]|x_{\tau-1}[i])p(x_\tau[i] = x[i]|x_{t-1}[i]) \quad \text{EQ. 13}$$

Based on the optimality principle, the optimal partial likelihood at the processing stage of t+1 can be computed using the following Viterbi recursion:

$$\delta_{t+1}(i) = \max_{i'} \delta_t(i')p(x_{t+1}[i] = x[i] \mid x_t[i] = x[i']) p(o_{t+1} \mid x_{t+1}[i] = x[i]) \quad \text{EQ. 14}$$

In equation 14, the "transition" probability $p(x_{t+1}[i]=x[i]|x_t[i]=x[i'])$ is calculated using state equation 6 above to produce a Gaussian distribution of:

$$p(x_{t+1}[i]=x[i]|x_t[i]=x[i'])=N(x_{t+1}[i];rx_t(i')+(1-r)T_s,B) \quad \text{EQ. 15}$$

where $rx_t(i')+(1-r)T_s$ is the mean of the distribution and B is the precision of the distribution. The value of $T_s$ is selected based on an initial HMM segmentation that is performed to align the frames with speech units. Such HMM segmentation systems are well known in the art.

The observation probability $p(o_{t+1}|x_{t+1}[i]=x[i])$ of equation 14 is treated as a Gaussian and is computed from observation equation 1 and the residual parameters h and D such that:

$$p(o_{t+1}|x_{t+1}[i]=x[i])=N(o_{t+1};C(x_{t+1}[i]+h,D) \quad \text{EQ. 16}$$

Back tracing of the optimal quantization index i' in equation 14 provides the estimated VTR sequence.

To reduce the number of computations that must be performed, a pruning beam search may be performed instead of a rigorous Viterbi search. In one embodiment, an extreme form of pruning is used where only one index is identified for each frame.

By using a target-based continuity constraint when determining the transition probabilities for the formants, the present invention allows for accurate tracking of formants even in non-sonorant speech regions. In addition, by using LPC-cepstrum feature vectors, the present invention avoids the need to store large simulated feature vectors. Instead, the simulated feature vectors can be easily calculated using equation 2 above during run time.

Although the present invention has been described with reference to particular embodiments, workers skilled in the art will recognize that changes may be made in form and detail without departing from the spirit and scope of the invention.

What is claimed is:

1. A method of tracking vocal tract resonant frequencies in a speech signal, the method comprising:

a processor determining an observation probability of an observation acoustic feature vector given a set of vocal tract resonant frequencies and vocal tract resonant bandwidths, wherein the observation probability, $p(o_t|x_t[i])$ is determined as:

$$p(o_t|x_t[i])=N(o_t;C(x_t[i])+h,D)$$

where $o_t$ is the observation acoustic feature vector at time t, $x_t[i]$ is the given set of vocal tract resonant frequencies and vocal tract resonant bandwidths, $N(o_t;C(x_t[i])+h,D)$ is a Gaussian distribution with a mean $C(x_t[i])+h$ and a precision D, h is a mean vector of a residual model that models differences between observation acoustic feature vectors and simulated feature vectors, D is a precision matrix of the residual model, and $C(x_t[i])$ is a simulated feature vector determined as:

$$C_n(x_t[i]) = \sum_{k=1}^{K} \frac{2}{n} e^{-\pi n \frac{b_k[i]}{f_s}} \cos\left(2\pi n \frac{f_k[i]}{f_s}\right)$$

where $C_n(x_t[i])$ is the nth element in an n order LPC-Cepstrum feature vector, K is the number of vocal tract resonant frequencies, $f_k$ is the kth vocal tract resonant frequency, $b_k$ is the kth vocal tract resonant bandwidth, and $f_s$ is a sampling frequency;

a processor determining a transition probability of a transition from a first set of vocal tract resonant frequencies and vocal tract resonant bandwidths to the given set of vocal tract resonant frequencies and vocal tract resonant bandwidths based in part on a target-guided constraint for the vocal tract resonant frequencies, wherein the transition probability is calculated as:

$$p(x_t[i]|x_{t-1}[j])=N(x_t[i];rx_{t-1}(j)+(1-r)T_s,B)$$

where $x_t[i]$ is the given set of vocal tract resonant frequencies and vocal tract resonant bandwidths at time t, $x_{t-1}[j]$ is the first set of vocal tract resonant frequencies and vocal tract resonant bandwidths at a previous time t−1, $N(x_t[i];rx_{t-1}(j)+(1-r)T_s,B)$ is a Gaussian distribution with mean $rx_{t-1}(j)+(1-r)T_s$ and precision B, r is a rate, and $T_s$ is a target that is tied to a speech unit s associated with time t for the vocal tract resonant frequencies and vocal tract resonant bandwidths; and a processor using the observation probability and the transition probability to select a set of vocal tract resonant frequencies corresponding to the observation acoustic feature vector.

2. The method of claim 1 wherein the mean for the residual model is trained using an Expectation Maximization algorithm.

3. A computer-readable storage medium having computer-executable instructions stored on the medium that when executed by a processor cause the processor to perform steps comprising:

receiving an input feature vector representing a frame of a speech signal;

mapping a vocal tract resonant frequency vector comprising a plurality of vocal tract resonant frequencies and a plurality of vocal tract resonant bandwidths into a simulated linear predictive coding cepstrum feature vector by calculating a separate function for each individual vocal tract resonant frequency and summing the results of each function to form an element of the simulated linear predictive coding cepstrum feature vector;

applying the input feature vector to a model to determine a probability that the plurality of vocal tract resonant frequencies of the vocal tract resonant frequency vector is present in the frame of the speech signal, wherein the model comprises a Gaussian distribution having a mean that is calculated as the sum of the simulated linear predictive coding cepstrum feature vector and a mean of a residual model, wherein the residual model models differences between observed training feature vectors and simulated linear predictive coding cepstrum feature vectors; and identifying a most likely plurality of vocal tract resonant frequencies based on the determined probability.

4. The computer-readable storage medium of claim 3 further comprising training the model using a plurality of simulated feature vectors generated from a plurality of vocal tract resonant frequency vectors and a plurality of training feature vectors generated from a training speech signal.

5. The computer-readable storage medium of claim 4 wherein training the model comprises performing Expectation Maximization training.

6. The computer-readable storage medium of claim 3 wherein determining a probability that the plurality of vocal tract resonant frequencies is present in the frame further comprises determining a probability of transitioning from a plurality of vocal tract resonant frequencies in a previous frame to the plurality of vocal tract resonant frequencies.

7. The computer-readable storage medium of claim 6 wherein determining a probability of transitioning from a plurality of vocal tract resonant frequencies in a previous frame comprises utilizing a target-guided constraint.

8. The computer-readable storage medium of claim 7 wherein the target-guided constraint is dependent on a speech unit assigned to a frame of speech.

9. A method of tracking vocal tract resonant frequencies in a speech signal, the method comprising:

a processor determining an observation probability of an observation acoustic feature vector given a set of vocal tract resonant frequencies, wherein determining an observation probability comprises utilizing a mapping between a set of vocal tract resonant frequencies and a feature vector to form a simulated feature and utilizing the simulated feature vector and a mean of a residual model that models differences between input feature vectors and feature vectors mapped from a set of vocal tract resonant frequencies to form a mean for a distribution that describes the observation probability by summing the simulated feature vector and the mean of the residual model;

a processor determining a transition probability of a transition from a first set of vocal tract resonant frequencies to a second set of vocal tract resonant frequencies based in part on a target-guided constraint for the vocal tract resonant frequencies; and a processor using the observation probability and the transition probability to select a set of vocal tract resonant frequencies corresponding to the observation acoustic feature vector.

10. The method of claim 9 wherein the mean for the residual model is trained using an Expectation Maximization algorithm.

11. The method of claim 9 wherein utilizing a mapping comprises calculating a separate function for each vocal tract resonant frequency and summing the results for each function to form an element of a simulated feature vector.

12. The method of claim 11 wherein utilizing a mapping further comprises utilizing a mapping between vocal tract resonant bandwidths and simulated feature vectors.

13. The method of claim 11 wherein forming an element of a simulated feature vector comprises forming an element of a linear predictive coding cepstrum feature vector.

14. The method of claim 9 wherein the transition probability is based on a Gaussian distribution having a mean that is based on a value of the first set of vocal tract resonant frequencies and a target for the second set of vocal tract resonant frequencies.

15. The method of claim 14 wherein the target is based on a speech unit associated with a frame of speech that formed the observation feature vector.

* * * * *